US007405745B2

(12) United States Patent
Chung

(10) Patent No.: US 7,405,745 B2
(45) Date of Patent: Jul. 29, 2008

(54) METHOD OF DRIVING PRINT HEAD AND IMAGE FORMING APPARATUS EMPLOYING THE SAME

(75) Inventor: Jin-tae Chung, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 250 days.

(21) Appl. No.: 11/281,699

(22) Filed: Nov. 18, 2005

(65) Prior Publication Data

US 2006/0109338 A1 May 25, 2006

(30) Foreign Application Priority Data

Nov. 20, 2004 (KR) ..... 10-2004-0095533

(51) Int. Cl.
*B41J 2/355* (2006.01)

(52) U.S. Cl. ..... 347/181; 400/120.05

(58) Field of Classification Search ..... 347/180–182; 400/120.05, 120.06

See application file for complete search history.

(56) References Cited

U.S. PATENT DOCUMENTS

| | | | | |
|---|---|---|---|---|
| 5,149,212 | A | 9/1992 | Murakami | |
| 5,357,268 | A * | 10/1994 | Kishida et al. | 347/13 |
| 5,412,406 | A * | 5/1995 | Fujimoto | 347/180 |
| 5,442,381 | A * | 8/1995 | Fukubeppu et al. | 347/182 |
| 5,625,391 | A * | 4/1997 | Hirabayashi et al. | 347/41 |
| 6,439,687 | B1 | 8/2002 | Inoue | |
| 6,890,060 | B2 * | 5/2005 | Yakura et al. | 347/41 |
| 7,165,823 | B2 * | 1/2007 | Yakura et al. | 347/12 |
| 2004/0041864 | A1 * | 3/2004 | Oikawa | 347/12 |
| 2004/0212647 | A1 | 10/2004 | Yakura et al. | |
| 2005/0243128 | A1 * | 11/2005 | Nakajima et al. | 347/41 |
| 2007/0103497 | A1 * | 5/2007 | Takamura | 347/12 |

FOREIGN PATENT DOCUMENTS

| | | |
|---|---|---|
| JP | 02-305656 | 12/1990 |
| JP | 07-156452 | 6/1995 |
| JP | 08-207284 | 8/1996 |
| JP | 2000-255046 | 9/2000 |
| JP | 2001-199074 | 7/2001 |
| KR | 1999-0072880 | 9/1999 |
| KR | 2003-0024697 | 3/2003 |
| KR | 10-2004-0019761 A | 3/2004 |

* cited by examiner

*Primary Examiner*—Huan H Tran
(74) *Attorney, Agent, or Firm*—Roylance, Abrams, Berdo, Goodman, LLP

(57) ABSTRACT

A method of driving a print head and an image forming apparatus employing the same are provided, wherein recording elements of the print head are divided into n groups and are driven to print an image on a medium, wherein recording elements from the respective n groups, that is, one recording element from each of the n groups, are simultaneously driven and a driving order of the recording elements is arranged such that printing positions of the recording elements in each group form a plurality of oblique lines as a medium is fed. Accordingly, the plurality of recording elements, which are divided into a plurality of phases, are non-sequentially driven and therefore, the power consumption due to the driving of the recording elements and degradation of print quality can be reduced.

15 Claims, 9 Drawing Sheets

METHOD OF DRIVING PRINT HEAD AND IMAGE FORMING APPARATUS EMPLOYING THE SAME

CROSS-REFERENCE TO RELATED APPLICATIONS

This application claims the benefit under 35 U.S.C. §119 (a) of Korean Patent Application No. 10-2004-0095533, filed in the Korean Intellectual Property Office on Nov. 20, 2004, the entire disclosure of which is incorporated herein by reference.

BACKGROUND OF THE INVENTION

1. Field of the Invention

The present invention relates to an image forming apparatus. More particularly, the present invention relates to a method of non-sequentially driving a plurality of recording elements of a print head, which are divided into a plurality of phases, and an image forming apparatus employing the same.

2. Description of the Related Art

In general, an image forming apparatus converts a document which a user makes using an application program, or an image which a user obtains using a digital camera or the like, into encoded data and outputs the data to media in a visible form.

Thermal transfer printing devices, which are used to obtain a high quality printed image, form an image by heating an ink ribbon in contact with a medium with a thermal print head and transferring an ink to the medium, or form an image by applying heat to a medium on which an ink layer is formed to reveal a predetermined color in response to the heat.

The thermal print head comprises a plurality of heaters, each having a predetermined resistance R. The plurality of heaters apply heat generated due to a predetermined applied voltage VHD to the medium, and print an image. Therefore, to obtain a high-quality printed image, the number of heaters of the thermal print head needs to be increased.

Power consumed in one heater due to the applied voltage VHD is calculated by Equation (1) below.

$$P = \frac{VHD^2}{R} \tag{1}$$

Therefore, as the number of heaters increases to obtain a high quality printed image, more power is consumed in a thermal print head.

Accordingly, a need exists for a system and method for reducing power consumption of an increased number of heaters provided to achieve high quality printed images in a thermal print head.

SUMMARY OF THE INVENTION

The present invention substantially solves the above and other problems, and provides a method of driving a print head and an image forming apparatus employing the method, wherein the print head comprises a plurality of recording elements divided into a plurality of phases so that the recording elements can be non-sequentially driven, and therefore, the power consumption and degradation of print quality are reduced.

According to an aspect of the present invention, a method is provided for driving recording elements of a thermal print head for printing an image on a medium, in which the recording elements are divided into n groups, wherein n recording elements from the n groups, that is, one recording element from each of the n groups, are simultaneously driven. The method further provides a driving order of the recording elements arranged such that printing positions of the recording elements in each group form a plurality of oblique lines as a medium is fed.

The recording element comprises a heater of a thermal print head which prints an image by applying heat to the medium, and the plurality of oblique lines preferably have the same slope.

When a print line is divided into twelve (12) phases and printed, the recording elements included in each group are preferably driven in an order comprising the first, sixth, eleventh, fourth, ninth, second, seventh, twelfth, fifth, tenth, third, and eighth element.

When a print line is divided into thirteen (13) phases and printed, the recording elements included in each group are preferably driven in an order comprising the first, tenth, sixth, second, eleventh, seventh, third, twelfth, eighth, fourth, thirteenth, ninth, and fifth element.

When a print line is divided into fourteen (14) phases and printed, the recording elements included in each group are preferably driven in an order comprising the first, fourth, seventh, tenth, thirteenth, second, fifth, eighth, eleventh, fourteenth, third, sixth, ninth, and twelfth element.

When a print line is divided into fifteen (15) phases and printed, the recording elements included in each group are preferably driven in an order comprising the first, fifth, ninth, thirteenth, second, sixth, tenth, fourteenth, third, seventh, eleventh, fifteenth, fourth, eighth, and twelfth element.

According to another aspect of the present invention, an image forming apparatus is provided for printing an image using a print head comprising a plurality of recording elements, the image forming apparatus comprising a data inputting unit for receiving image data intended to be printed, a controlling unit for generating and outputting a control signal for driving the recording elements according to the received image data, and a print head comprising recording elements divided into n groups and printing an image on a medium by driving the recording elements in response to the control signal. The controlling unit generates the control signal for simultaneously driving n recording elements from the respective n groups, that is, one recording element from each of the n groups, and controlling the recording elements so that printing positions of the recording elements driven in each group form a plurality of oblique lines as the medium is fed.

The recording element preferably comprises a heater of a thermal print head which prints an image by applying heat to a medium, and the plurality of oblique lines preferably have the same slope.

When a print line is divided into twelve (12) phases and printed, the controlling unit preferably generates a control signal for driving the recording elements included in each group in an order comprising the first, sixth, eleventh, fourth, ninth, second, seventh, twelfth, fifth, tenth, third, and eighth element.

When a print line is divided into thirteen (13) phases and printed, the controlling unit preferably generates a control signal for driving the recording elements included in each group in an order comprising the first, tenth, sixth, second, eleventh, seventh, third, twelfth, eighth, fourth, thirteenth, ninth, and fifth element.

When a print line is divided into fourteen (14) phases and printed, the controlling unit preferably generates a control signal for driving the recording elements included in each group in an order comprising the first, fourth, seventh, tenth, thirteenth, second, fifth, eighth, eleventh, fourteenth, third, sixth, ninth, and twelfth element.

When a print line is divided into fifteen (15) phases and printed, the controlling unit preferably generates a control signal for driving the recording elements included in each group in an order comprising the first, fifth, ninth, thirteenth, second, sixth, tenth, fourteenth, third, seventh, eleventh, fifteenth, fourth, eighth, and twelfth element.

The print head driving method can be embodied as a computer readable recording medium having embodied thereon a computer program for executing the method.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF THE EXEMPLARY EMBODIMENTS

Figure 1:
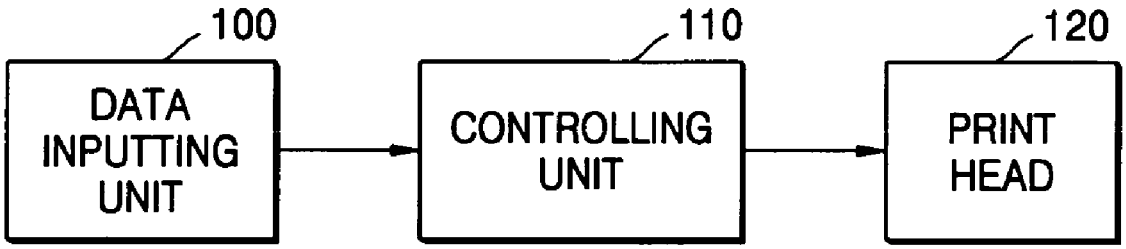
FIG. 1 is a block diagram of a structure of an image forming apparatus according to an embodiment of the present invention.

FIG. 1 is a block diagram of a structure of an image forming apparatus according to an embodiment of the present invention. The image forming apparatus comprises a data inputting unit 100, a controlling unit 110, and a print head 120.

The data inputting unit 100 receives image data to be printed from a personal computer (PC), digital camera, personal digital assistant (PDA), or the like.

The controlling unit 110 generates control signals which control the operation of the print head 120 according to the received image data. The print head 120 receives the control signals from the controlling unit 110 and prints an image on a medium by driving a plurality of recording elements. The print head 120 may comprise, for example, an inkjet head or a thermal print head. An inkjet head comprises a plurality of nozzles for delivering ink droplets to respective corresponding dots to be printed. Each nozzle delivers an ink droplet and prints an image using a piezoelectric element in a piezoelectric inkjet printer, or by using a heater in a thermal inkjet printer. A thermal print head prints an image by applying heat to a medium using a plurality of heaters, each of which corresponds to a dot.

Figure 2:
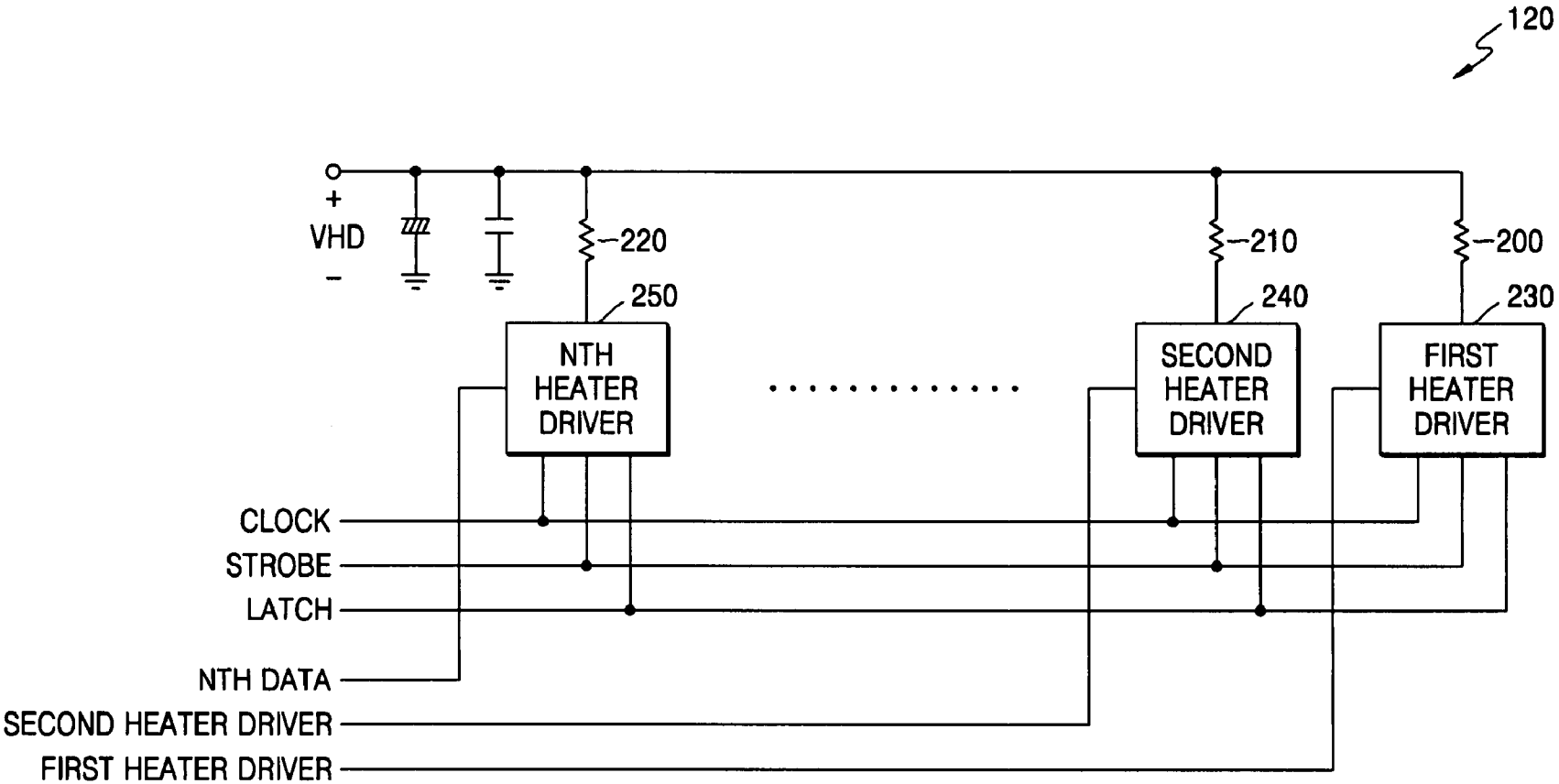
FIG. 2 is a block diagram of a structure of a thermal print head according to an embodiment of the present invention.

FIG. 2 is a block diagram of a structure of a thermal print head according to an embodiment of the present invention. The thermal print head comprises a plurality of heaters 200, 210, and 220, and a plurality of heater drivers 230, 240, and 250.

The heaters 200, 210, and 220, apply heat to a medium (not shown), and are driven by the corresponding heater drivers 230, 240, and 250. For example, a 300 dpi, 3-inch thermal print head comprises 900 heaters, and the heaters apply heat generated due to an applied voltage (VHD), to a medium by being turned on/off by 900 corresponding heater drivers.

Figure 3:
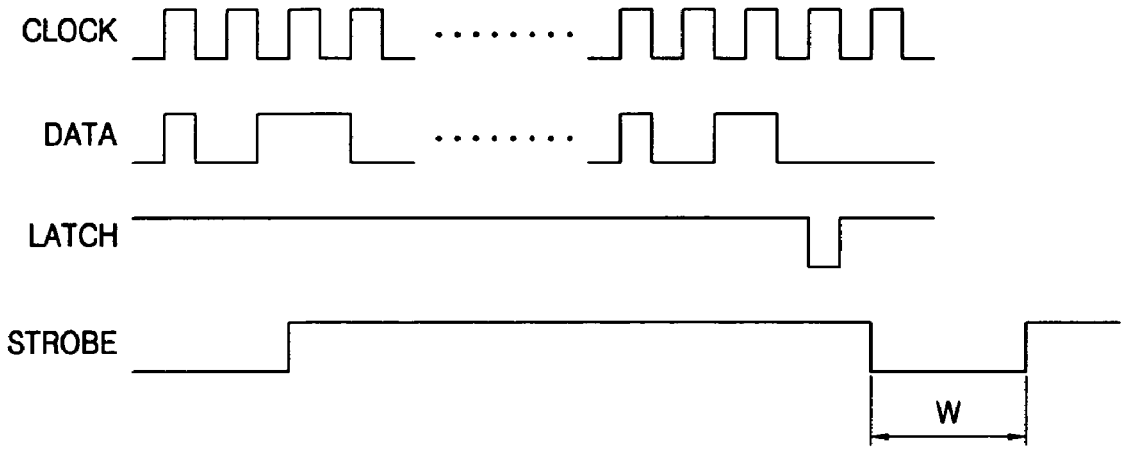
FIG. 3 is a timing diagram illustrating control signals for driving the thermal print head according to an embodiment of the present invention.

FIG. 3 is a timing diagram illustrating control signals that are input for one gray scale to drive the thermal print head according to an embodiment of the present invention. The operations of the thermal print head and the heaters will now be described in greater detail with reference to FIG. 3. Image data comprising information about whether the respective heaters 200, 210, and 220, of the thermal print head are heated, that is, information about whether the respective heaters are turned on/off is synchronised with a clock and serially input to a shift register in the heater driver 230, 240, or 250. When data corresponding to all heaters is input, the input data is temporarily stored in flip-flops of the heater drivers 230, 240, and 250, corresponding to the respective heaters 200, 210, and 220, according to a latch signal. When the data values of the respective heaters 200, 210, and 220, which are stored in the flip-flops, are all high, the heaters 200, 210, and 220, apply heat to a medium for a period of time W for which a strobe signal is low.

Figure 4:
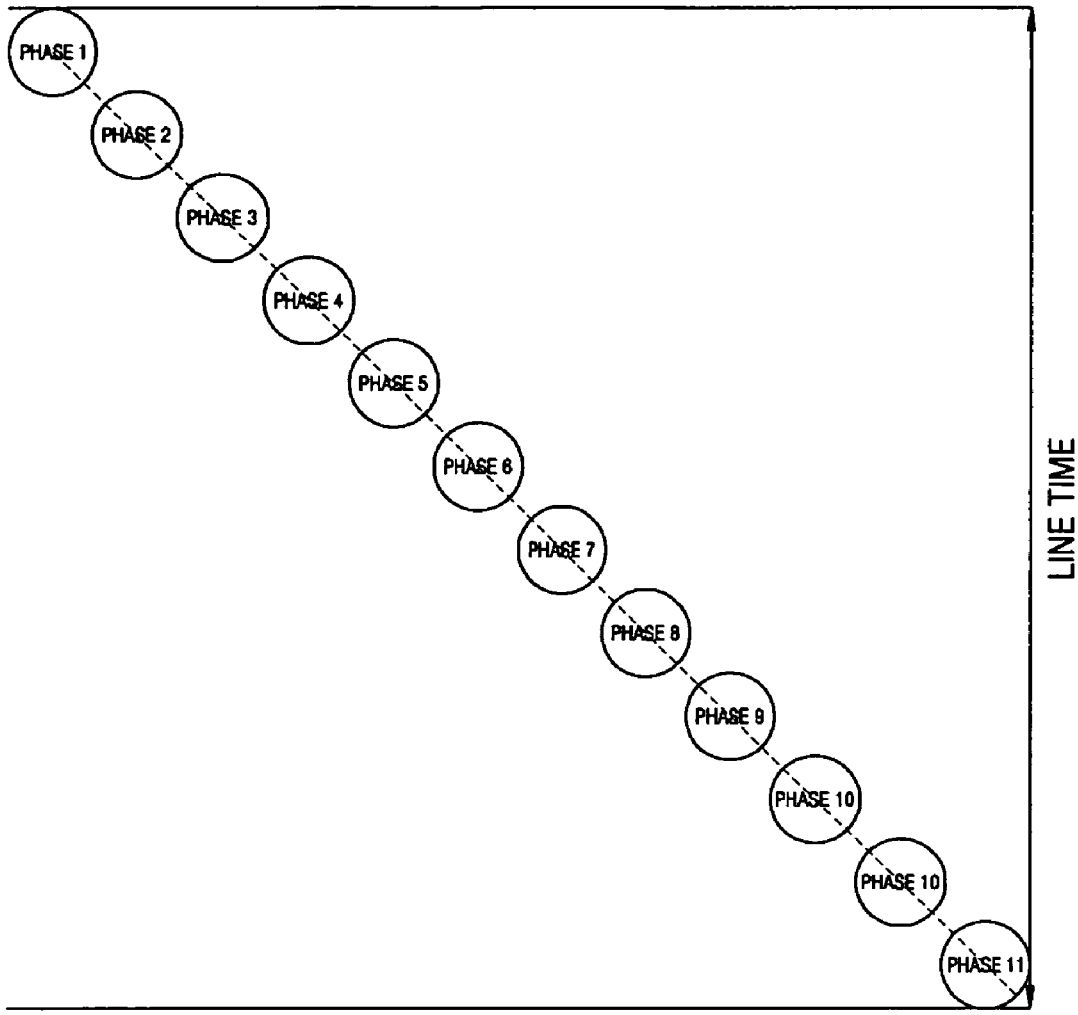
FIG. 4 illustrates an embodiment of a method of driving recording elements that are divided into eleven (11) phases.

FIG. 4 illustrates an embodiment of a method of driving recording elements that are divided into eleven (11) phases. To print one print line that is divided into 11 phases, the heaters of the thermal print head are divided into groups of eleven heaters, and the heaters are sequentially driven. In a first phase, a first heater is driven to print a dot, in a second phase, a second heater is driven to print a dot, and in a third phase, a third heater is driven to print a dot, and so on. In this manner, heat is sequentially applied to a medium, and therefore, an image is diagonally formed on the medium as the medium is fed (or the thermal print head is moved) as shown in FIG. 4.

Figure 5:
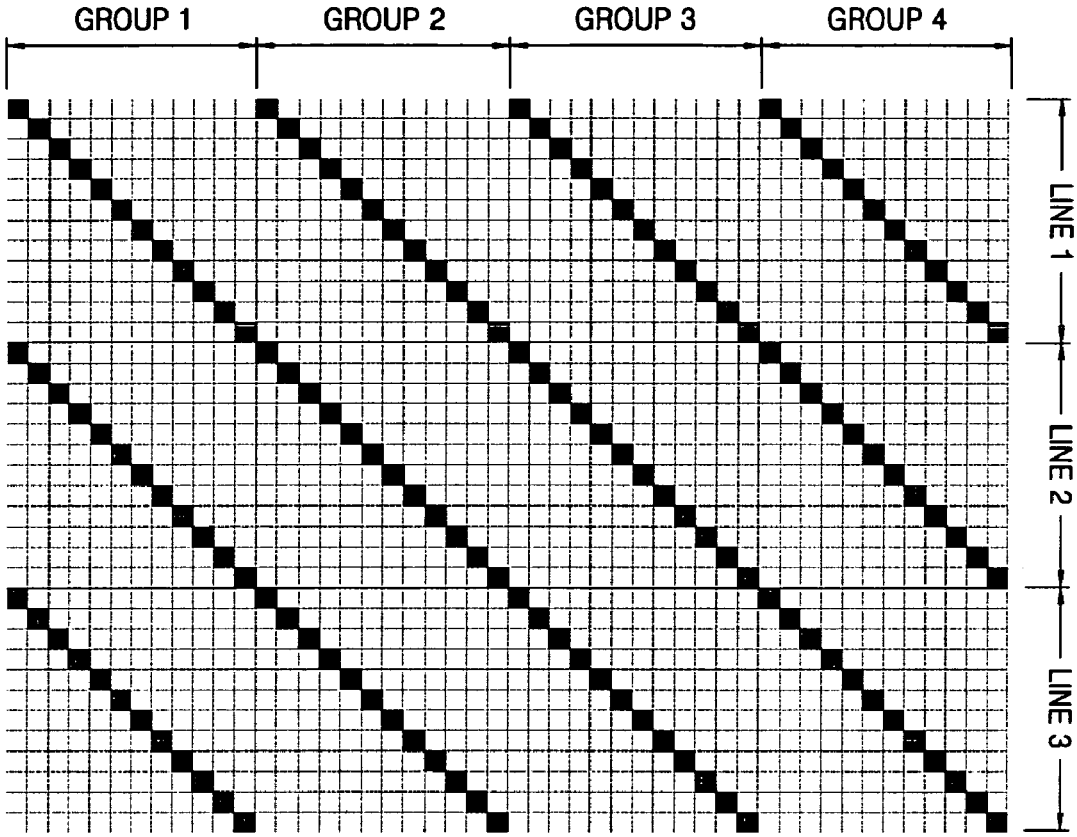
FIG. 5 illustrates an embodiment of a method of driving a plurality of recording elements that are divided into twelve (12) phases.

FIG. 5 illustrates an embodiment of a method of driving a plurality of recording elements that are divided into twelve (12) phases. In FIG. 5, 48 heaters are divided into four groups and sequentially driven to print three lines using the driving method illustrated in FIG. 4. According to the method shown in FIG. 5, the power consumption is reduced to one twelfth of that when the recording elements are not divided into phases, and an image of a single oblique line is formed with respect to each group of heaters.

Figure 6:
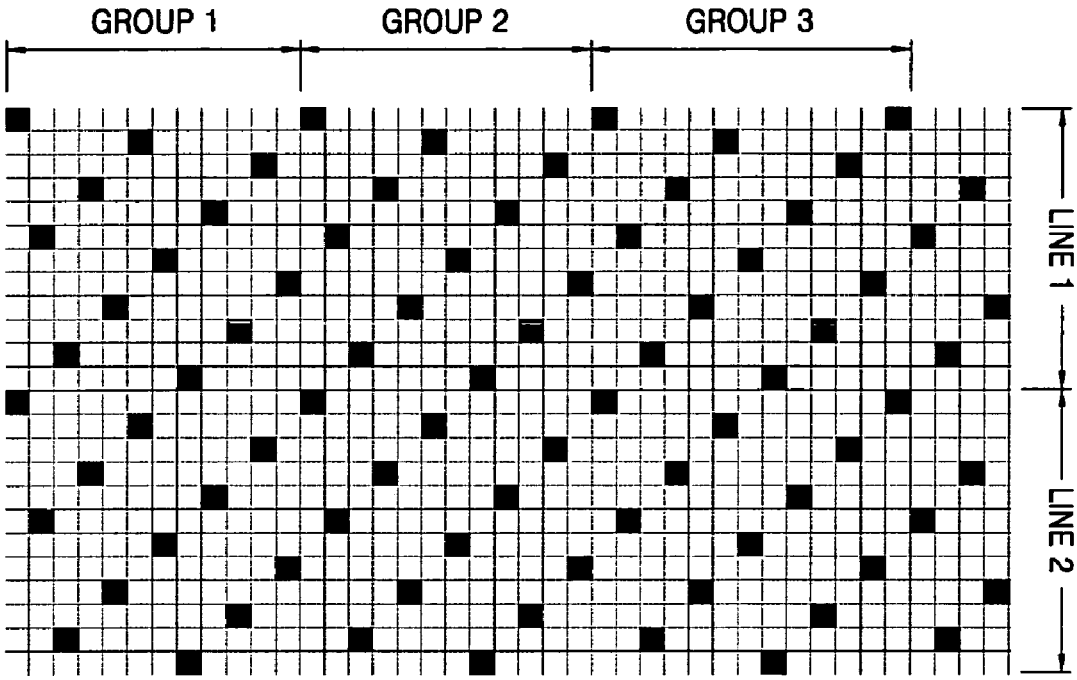
FIG. 6 illustrates another embodiment of a method of driving a plurality of recording elements that are divided into twelve (12) phases.

FIG. 6 illustrates another embodiment of a method of driving a plurality of recording elements that are divided into twelve (12) phases. Unlike the methods shown in FIGS. 4 and 5, the heaters are not sequentially driven; instead, the order of driving is rearranged such that printing positions of the recording element in each group form a plurality of oblique lines. That is, the heaters included in every group (that is, in each of Group 1, 2, 3 and so on) are driven in an order comprising the first, sixth, eleventh, fourth, ninth, second, seventh, twelfth, fifth, tenth, third, and eighth heater (from top to bottom). According to this method, the power consumption is reduced to one twelfth of that when the phases are not divided, which is the same as the method shown in FIG. 5 except that the order is changed such that an image of a plurality of oblique lines is formed with respect to each group. Therefore, a more uniform image is formed as compared to the image shown in FIG. 5.

To rearrange the driving order of the heaters, the image forming apparatus may comprise a driving order arranging unit (not shown) that converts image data, which has information about whether respective heaters of the thermal print head shown in FIG. 3 are heated, into new image data which further comprises the driving order of the heaters intended to be rearranged. Alternatively, offset values comprising information about times for which the respective heaters are driven may be adjusted according to the driving order of the heaters intended to be rearranged.

Figure 7:
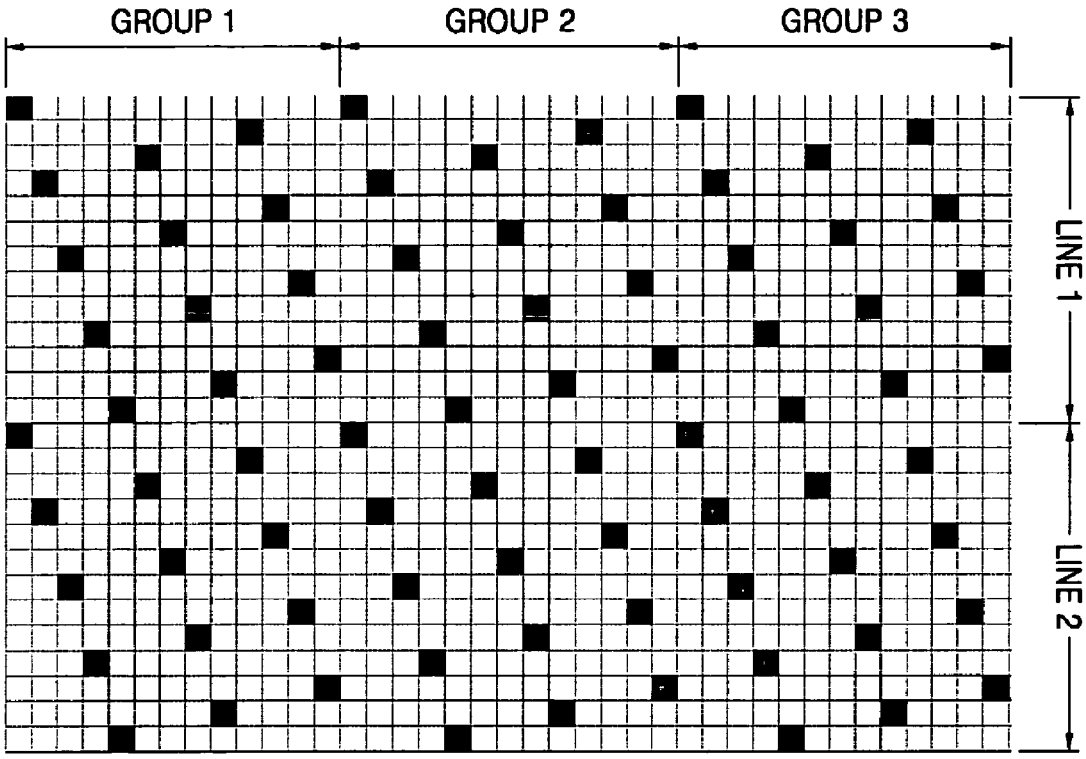
FIG. 7 illustrates an embodiment of a method of driving a plurality of recording elements that are divided into thirteen (13) phases.

FIG. 7 illustrates an embodiment of a method of driving a plurality of recording elements that are divided into thirteen (13) phases. The driving order of the heaters is non-sequentially rearranged, and an image of a plurality of oblique lines is formed and printed with respect to each group. That is, the recording elements included in each group are driven in an order comprising the first, tenth, sixth, second, eleventh, seventh, third, twelfth, eighth, fourth, thirteenth, ninth, and fifth elements. According to this method, the power consumption is reduced to one thirteenth of that when the phases are not divided, which is less than the method shown in FIG. 5. As in FIG. 6, an image of a plurality of oblique lines is formed with respect to every group, therefore, a more uniform image is formed as compared to the image of FIG. 5.

Figure 8:
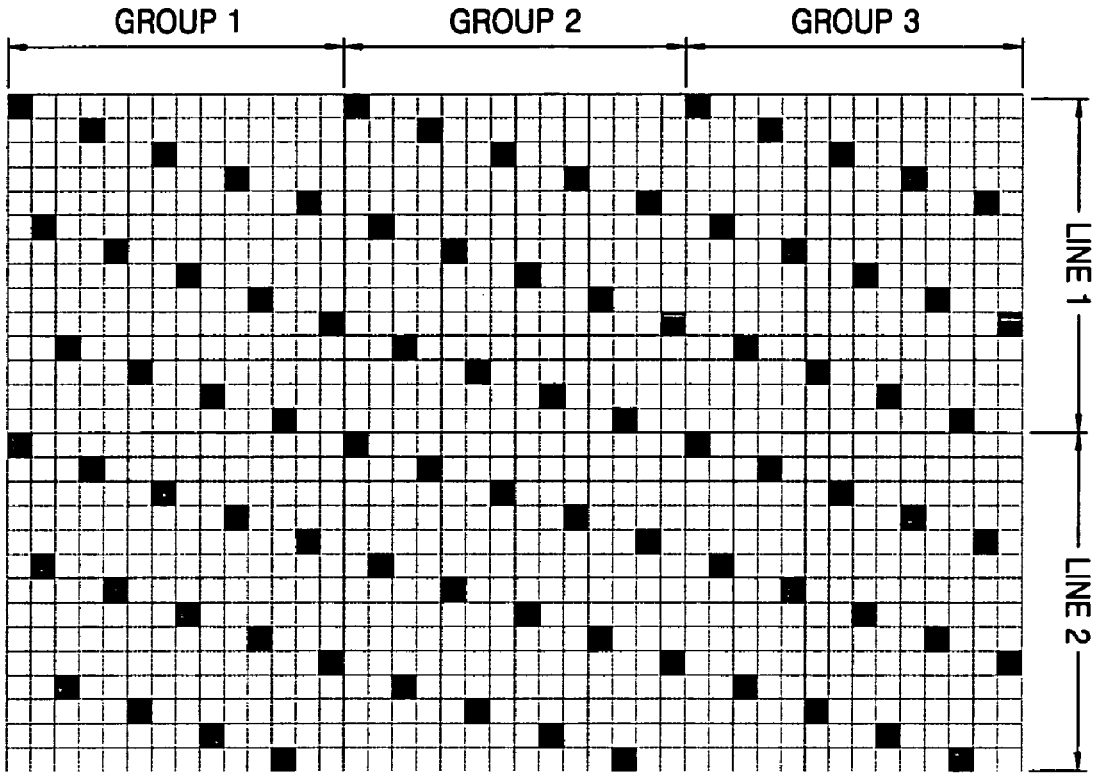
FIG. 8 illustrates an embodiment of a method of driving a plurality of recording elements that are divided into fourteen (14) phases.

FIG. 8 illustrates an embodiment of a method of driving a plurality of recording elements that are divided into fourteen (14) phases. The driving order of heaters is rearranged, and an image of a plurality of oblique lines is formed and printed with respect to each group. That is, the heaters included in each group are driven in an order comprising the first, fourth, seventh, tenth, thirteenth, second, fifth, eighth, eleventh, fourteenth, third, sixth, ninth, and twelfth heater.

Figure 9:
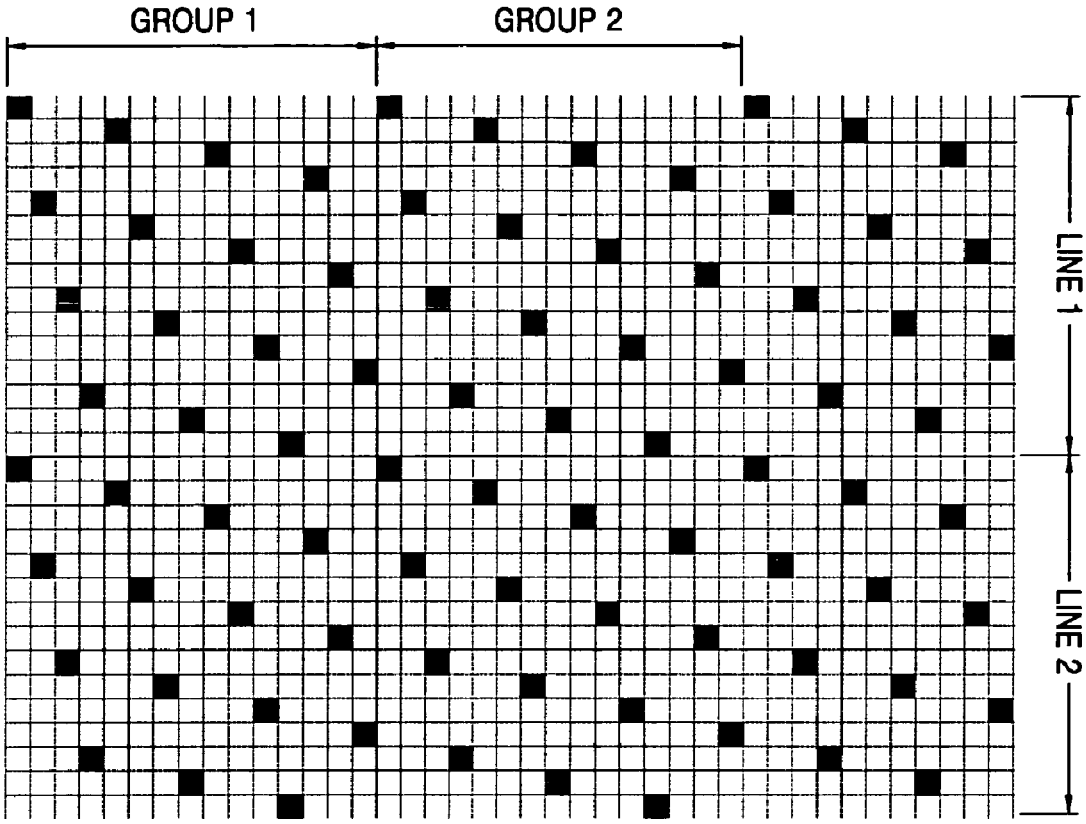
FIG. 9 illustrates an embodiment of a method of driving a plurality of recording elements that are divided into fifteenth (15) phases.

FIG. 9 illustrates an embodiment of a method of driving a plurality of recording elements that are divided into fifteen (15) phases. The driving order of heaters is rearranged, and an image of a plurality of oblique lines is formed and printed with respect to each group. That is, the heaters included in each group are driven in an order comprising the first, fifth, ninth, thirteenth, second, sixth, tenth, fourteenth, third, seventh, eleventh, fifteenth, fourth, eighth, and twelfth heater.

The invention can also be embodied as computer readable codes on a computer readable recording medium. The computer readable recording medium can be comprised of any data storage device that can store data which can be read by a computer system. Examples of such a computer readable recording medium include read-only memory (ROM), random-access memory (RAM), CD-ROM, magnetic tape, floppy disk, optical data storage device, and carrier wave (such as data transmission through a network or the Internet). The computer readable recording medium can also be distributed over network coupled computer systems so that the computer readable code is stored and executed in a distributed fashion. Also, functional programs, codes, and code segments for accomplishing embodiments of the present invention can be easily understood by programmers skilled in the art to which the present invention pertains.

As described above, according to embodiments of the present invention, a method and apparatus is provided for driving a print head comprising a plurality of recording elements. The method and apparatus is provided for non-sequentially driving the recording elements (or heaters), which are divided into a plurality of phases, when an image is printed using the print head. Accordingly, the power consumption due to the driving of the recording elements and degradation of print quality can be reduced.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A method of driving recording elements of a print head for printing an image on a medium, comprising the steps of:

dividing the recording elements into n groups; and substantially simultaneously driving one recording element from each of the n groups in a non-sequential order, wherein a pulse width of each driven element is controlled by a single strobe, such that printing positions of the recording elements in each group form a plurality of oblique lines on a medium.

2. The method of claim 1, wherein the recording elements comprise heaters of a thermal print head which print an image by applying heat to the medium.

3. The method of claim 1, wherein the plurality of oblique lines have substantially the same slope.

4. The method of claim 1, further comprising the steps of:

dividing a print line into twelve (12) phases; and driving the recording elements included in each group in an order comprising a first, sixth, eleventh, fourth, ninth, second, seventh, twelfth, fifth, tenth, third, and eighth element, to print the line.

5. The method of claim 1, further comprising the steps of:

dividing a print line into thirteen (13) phases; and driving the recording elements included in each group in an order comprising a first, tenth, sixth, second, eleventh, seventh, third, twelfth, eighth, fourth, thirteenth, ninth, and fifth element, to print the line.

6. The method of claim 1, further comprising the steps of:

dividing a print line into fourteen (14) phases; and driving the recording elements included in each group in an order comprising a first, fourth, seventh, tenth, thirteenth, second, fifth, eighth, eleventh, fourteenth, third, sixth, ninth, and twelfth element, to print the line.

7. The method of claim 1, further comprising the steps of:

dividing a print line into fifteen (15) phases; and driving the recording elements included in each group in an order comprising a first, fifth, ninth, thirteenth, second, sixth, tenth, fourteenth, third, seventh, eleventh, fifteenth, fourth, eighth, and twelfth element, to print the line.

8. A computer readable recording medium having embodied thereon a computer program for driving recording elements of a print head for printing an image on a medium, the computer readable recording medium comprising:

a first set of instructions for dividing the recording elements into n groups; and a second set of instructions for substantially simultaneously driving one recording element from each of the n groups in a non-sequential order, wherein a pulse width of each driven element is controlled by a single strobe, such that printing positions of the recording elements in each group form a plurality of oblique lines on a medium.

9. An image forming apparatus for printing an image using a print head including a plurality of recording elements, the image forming apparatus comprising:

a data inputting unit for receiving image data to be printed;

a controlling unit for generating and outputting a control signal for driving the recording elements according to the received image data; and a print head comprising a plurality of recording elements divided into n groups for printing an image on a medium by driving the recording elements in response to the control signal, wherein the controlling unit is configured to generate the control signal for substantially simultaneously driving one recording element from each of the n groups in a non-sequential order, and a pulse width of each driven element is controlled by a single strobe, such that printing positions of the recording elements driven in each group form a plurality of oblique lines on the medium.

10. The image forming apparatus of claim 9, wherein the recording elements comprise heaters of a thermal print head which print an image by applying heat to a medium.

11. The image forming apparatus of claim 9, wherein the plurality of oblique lines have substantially the same slope.

12. The image forming apparatus of claim 9, wherein, when a print line is divided into twelve (12) phases, the controlling unit is configured to generate a control signal for driving the recording elements included in each group in an order comprising a first, sixth, eleventh, fourth, ninth, second, seventh, twelfth, fifth, tenth, third, and eighth element, to print the line.

13. The image forming apparatus of claim 9, wherein, when a print line is divided into thirteen (13) phases, the controlling unit is configured to generate a control signal for driving the recording elements included in each group in an order comprising a first, tenth, sixth, second, eleventh, seventh, third, twelfth, eighth, fourth, thirteenth, ninth, and fifth element, to print the line.

14. The image forming apparatus of claim 9, wherein, when a print line is divided into fourteen (14) phases, the controlling unit is configured to generate a control signal for driving the recording elements included in each group in an order comprising a first, fourth, seventh, tenth, thirteenth, second, fifth, eighth, eleventh, fourteenth, third, sixth, ninth, and twelfth element, to print the line.

15. The image forming apparatus of claim 9, wherein, when a print line is divided into fifteen (15) phases, the controlling unit is configured to generate a control signal for driving the recording elements included in each group in an order comprising a first, fifth, ninth, thirteenth, second, sixth, tenth, fourteenth, third, seventh, eleventh, fifteenth, fourth, eighth, and twelfth element, to print the line.

* * * * *